US005239615A

United States Patent [19]

Moore et al.

[11] Patent Number: 5,239,615

[45] Date of Patent: * Aug. 24, 1993

[54] SYSTEM FOR TRANSPORTING HIGHLY VISCOUS WATERPROOFING MEMBRANE

[75] Inventors: Monty D. Moore; Dennis L. Moore, both of Bothell, Wash.

[73] Assignee: Pacific Rainier Roofing, Inc., Seattle, Wash.

[ * ] Notice: The portion of the term of this patent subsequent to Mar. 3, 2009 has been disclaimed.

[21] Appl. No.: 815,484

[22] Filed: Dec. 31, 1991

Related U.S. Application Data

[63] Continuation of Ser. No. 583,287, Sep. 17, 1990, Pat. No. 5,093,896.

[51] Int. Cl.[5] ..... B67D 5/62; F24H 1/18

[52] U.S. Cl. ..... 392/441; 392/480; 219/420; 126/343.5 A; 239/130; 137/341

[58] Field of Search ..... 392/441, 480; 219/420, 219/421; 126/343.5 A; 222/146.1, 146.2, 146.5; 239/130; 137/341

[56] References Cited

U.S. PATENT DOCUMENTS

| | | | |
|---|---|---|---|
| 198,359 | 12/1877 | Dietz . | |
| 1,931,793 | 10/1933 | Gleason | 94/42 |
| 1,984,851 | 12/1934 | Vinz . | |
| 2,224,403 | 12/1940 | Lines . | |
| 2,802,520 | 8/1957 | Trabilcy . | |
| 2,824,209 | 2/1958 | Leipold | 219/46 |
| 3,033,245 | 5/1962 | Schreter et al. | 141/28 |
| 3,106,344 | 10/1963 | Baird, Jr. et al. | 239/130 |
| 3,301,441 | 1/1967 | Werner et al. | 222/146 |
| 3,359,970 | 12/1967 | Pedersen et al. | 126/343.5 |
| 3,378,673 | 4/1968 | Hopper | 219/301 |
| 3,585,361 | 6/1971 | Rosen et al. | 219/422 |
| 3,622,748 | 11/1971 | Sellers | 219/421 |
| 3,682,054 | 8/1972 | MacPhail et al. | 239/150 |
| 3,789,188 | 1/1974 | Rudbarg | 138/148 |
| 3,841,527 | 10/1974 | Von Roeschlaub | 222/146 |
| 4,028,527 | 6/1977 | Thagard, Jr. | 219/311 |
| 4,096,973 | 6/1978 | Checko | 222/146 |
| 4,247,022 | 1/1981 | Fung et al. | 141/115 |
| 4,455,474 | 6/1984 | Jameson et al. | 219/301 |
| 4,545,504 | 10/1985 | Fabel et al. | 222/146.1 |
| 4,620,645 | 11/1986 | Hale | 222/146.1 |
| 4,667,084 | 5/1987 | Regge | 219/300 |
| 4,725,713 | 2/1988 | Lehrke | 219/505 |

*Primary Examiner*—Bruce A. Reynolds
*Assistant Examiner*—John A. Jeffery
*Attorney, Agent, or Firm*—Christensen, O'Connor, Johnson & Kindness

[57] ABSTRACT

A system for transporting liquefied, highly viscous waterproofing membrane from a kettle where the membrane is heated and stored to a remote location. The system comprises a pump assembly for pumping membrane out of the kettle, a pipe assembly coupled with the pump assembly for providing a passageway along which the membrane may be transported from the pump assembly to an intermediate location, and a lugger for receiving membrane discharged from the pipe assembly and for transporting the membrane to the remote location. The pipe assembly and the lugger include heating devices for maintaining the temperature of membrane being transported thereby at a selected temperature, typically in the range of 375° F. to 425° F.

7 Claims, 7 Drawing Sheets

SYSTEM FOR TRANSPORTING HIGHLY VISCOUS WATERPROOFING MEMBRANE

This is a continuation application based on U.S. Pat. application Ser. No. 07/583,287, filed Sep. 17, 1990, now U.S. Pat. No. 5,093,896;

FIELD OF THE INVENTION

The present invention relates to systems for transporting liquefied, hot-applied waterproofing material, and more particularly to systems for transporting liquefied highly viscous waterproofing membrane of the type which is applied at temperatures of about 400° F.

BACKGROUND OF THE INVENTION

Waterproofing membranes made up of refined asphalts, synthetic rubbers, and extenders have been widely used for several decades for sealing horizontal, vertical, or transverse surfaces. Such waterproofing membranes are characterized by a high degree of flexibility over a wide temperature range, the ability to self heal when lightly damaged, tenacious adherence to the surface to which they are applied, the ability to bridge relatively wide cracks without the need for flashing, and extreme longevity.

One class of such waterproofing membranes, referred to hereinafter as "viscous membrane" and exemplified by Liquid Membrane 6125® manufactured by American Hydrotech, Inc., Chicago, Ill., is very popular and widely used due to its exceptional functional characteristics. Typically, viscous membrane is heated to about 400° F. prior to application so as to liquefy the material and reduce its viscosity to a point where it is spreadable. Then, the viscous membrane is poured onto a surface and is spread out using conventional spreading tools.

Viscous membrane tends to be difficult to transport from the kettle where the membrane is liquefied to the surface on which the material is to be applied when the surface is remote from the kettle. This difficulty arises due to the tendency of the material to freeze to the wall of the container in which it is being transported if the material remains in the container for more than about 15 minutes. For instance, when the viscous membrane is to be applied to the roof of a multi-story structure and fire code or other considerations require that the kettle in which the viscous membrane is heated be positioned on the ground adjacent the structure, rather than on the roof, it is not uncommon for the membrane to build up on the walls of the containers in which it is transported such that after three or four loads the containers are completely filled with solid viscous membrane. Then, the solid viscous membrane must be melted out of the containers using known processes which are time and labor intensive.

To avoid the above-noted freeze-up problems associated with transporting viscous membrane, an attempt was made in Canada to develop a system for pumping liquefied viscous membrane from the kettle in which it is stored through a pipe to a location remote from the kettle. The system was designed for use with a conventional oil-jacketed, gas jet-fired kettle of the type manufactured by Industrial Waterproof Systems, Ltd., Calgary, Alberta, and identified as a sevenproof melter. Such a kettle has a chamber for receiving the viscous membrane which is about 3 feet deep. The system included a conventional pump of the type used to pump liquefied roofing asphalt, and a pipe assembly coupled to the output of the pump for transporting the viscous membrane to a remote location. The intake for the pump was positioned in the chamber of the kettle just below the surface level of the liquefied viscous membrane stored in the chamber. The kettle was located on a substantially level surface, and was level with respect to the surface. The pipe assembly included a plurality of pipe sections, each comprising an inner pipe, an outer pipe surrounding and coupled with the inner pipe, and insulation positioned between the inner and outer pipes. The pipe sections were designed to be attached end-to-end so as to form a continuous elongate pipe assembly. Each inner pipe included a heating coil which was only slightly longer than the length of the pipe. As a consequence of the length of the coil, it is believed that the latter was wrapped only once around the inner pipe. The heating coils were designed to be powered by 110 volt source, with a separate power cord being provided for the heating coil of each pipe section.

Unfortunately, it is believed that the above-described system did not function effectively.

Other systems and devices are known for storing asphalt-based roofing and paving materials in a liquefied and/or heated state, and for transporting such materials from one location to another location. For instance, devices for storing asphalt-based materials in a liquid state and for pumping such materials to a remote site are disclosed in U.S. Pat. Nos. 3,033,245; 3,359,970; 3,841,527; 4,247,022; and 4,620,645. Heated pipe systems for transporting heated, liquefied materials such as roofing asphalt are disclosed in U.S. Pat. Nos. 2,824,209; 3,378,673; 3,789,188; 4,455,474; and 4,667,084. Systems for storing and transporting heated asphalt-based materials are disclosed in U.S. Pat. Nos. 198,359; 1,931,793; 3,301,441; 3,622,748; and 4,028,527.

It is believed that none of the systems described in the above-listed patents are designed to store and transport liquefied viscous membrane which has been heated to a temperature of about 400° F. Both the temperature and the high viscosity of viscous membrane would tend to render the systems described in the above-listed patents inoperative, or may even destroy such systems.

As a consequence of the failure of the above-described system for pumping viscous membrane, and due to the inapplicability of the devices disclosed in the above-noted patents as means for storing and transporting viscous membrane, a strong need continues to exist for a system for transporting viscous membrane from the kettle where it is liquefied to a remote location. Such a system is desired by the construction industry because the labor costs associated with applying viscous membrane on a surface remote from the kettle where the membrane is liquefied are often double those incurred when the kettle is positioned near or on the surface. In addition, such a system is desired because structural and fire safety considerations often make it unfeasible to place the kettle for heating viscous membrane on the roof on which viscous membrane is to be applied.

SUMMARY OF THE INVENTION

The present invention is a system for transporting liquefied, highly viscous waterproofing membrane from the chamber of the kettle where it is heated and stored to a remote location where it is to be applied. The system comprises a pump assembly, a pipe assembly, and a lugger. The pump assembly is designed to draw liquefied viscous membrane out of the chamber of the kettle and to deliver the liquefied viscous membrane in a continuous stream. The pipe assembly is coupled with the pump assembly and is designed (1) to enclose a passageway through which the stream of liquefied viscous membrane delivered by the pump assembly may be transported from the pump assembly to an intermediate location between the pump assembly and the remote location, and (2) to retain the liquefied viscous membrane located in the passageway at a selected temperature in a predetermined temperature range. Typically, this temperature range is 375° F. to 425° F. The lugger is designed (1) to receive a predetermined quantity of the liquefied viscous membrane which has been transported by the pipe assembly to the intermediate location, (2) to store the predetermined quantity of liquefied viscous membrane so that the latter remains at the selected temperature in the predetermine temperature range, and (3) to transport the predetermined quantity of liquefied viscous membrane from the intermediate location to the remote location.

BRIEF DESCRIPTION OF THE DRAWINGS

In the drawings, like reference numerals refer to like parts.

DETAILED DESCRIPTION OF THE INVENTION

The present invention is a system for transporting liquefied, highly viscous waterproofing membrane, which has been heated in a kettle to a temperature of about 375° F. to 425°, from the kettle to a surface on which the membrane is to be applied.

The present system is designed to transport waterproofing membrane characterized by the following physical properties, as determined in accordance with the known Canadian Government Specification Board test methods identified as CGSB 37-GB-50, which test methods are incorporated herein by reference:

| Properties | Results |
|---|---|
| Flashpoint | 500° F. |
| Penetration | At 77° F., max 100, at 122° F., max 200 |
| Flow | At 120° F., none, at 140° F., 3.0 mm-max |
| Elasticity/Ratio of toughness to peak load | Minimum toughness of 25 inch/pounds (29 cm-kg)/.04 (29 cm-kg)/.04 |
| Water vapor permeability | 0.01 perms (0.0066 metric perms) |
| Water absorption | 24 hours/.07%, 48 hours/.10%, 72 hours/.11% |
| Water resistance | No delamination, blistering, emulsification, or deterioration |
| Low temperature flexibility | No delamination, adhesive loss, or cracking |
| Low temperature crack bridging ability | No cracking, adhesion loss, or splitting |
| Heat stability | No change in viscosity, penetration, flow or low temperature flexibility after aging |
| Viscosity | 2–10 seconds |

Additionally, the softening point of waterproofing membrane of the type the present system is designed to transport is about 130° F., as determined by the test method developed by the American Society For Testing and Materials and identified by the number ASTM-D-36, which test method is incorporated herein by reference. In addition to the foregoing properties, waterproofing membrane of the type the present system is designed to transport does not include any solvents, i.e., it is 100% solids. In addition, this waterproofing membrane has a good resistance to mild acids, and may be applied at a minimum ambient temperature of as low as 0° F.

As used hereinafter in the specification and the claims, "viscous membrane" shall refer to waterproofing membrane having physical properties that are similar to, if not identical to, the properties set forth above.

An exemplary waterproofing membrane having the foregoing physical properties is manufactured by American Hydrotech, Inc., Chicago, Ill., and is identified as Liquid Membrane 6125 ®.

Figure 1:
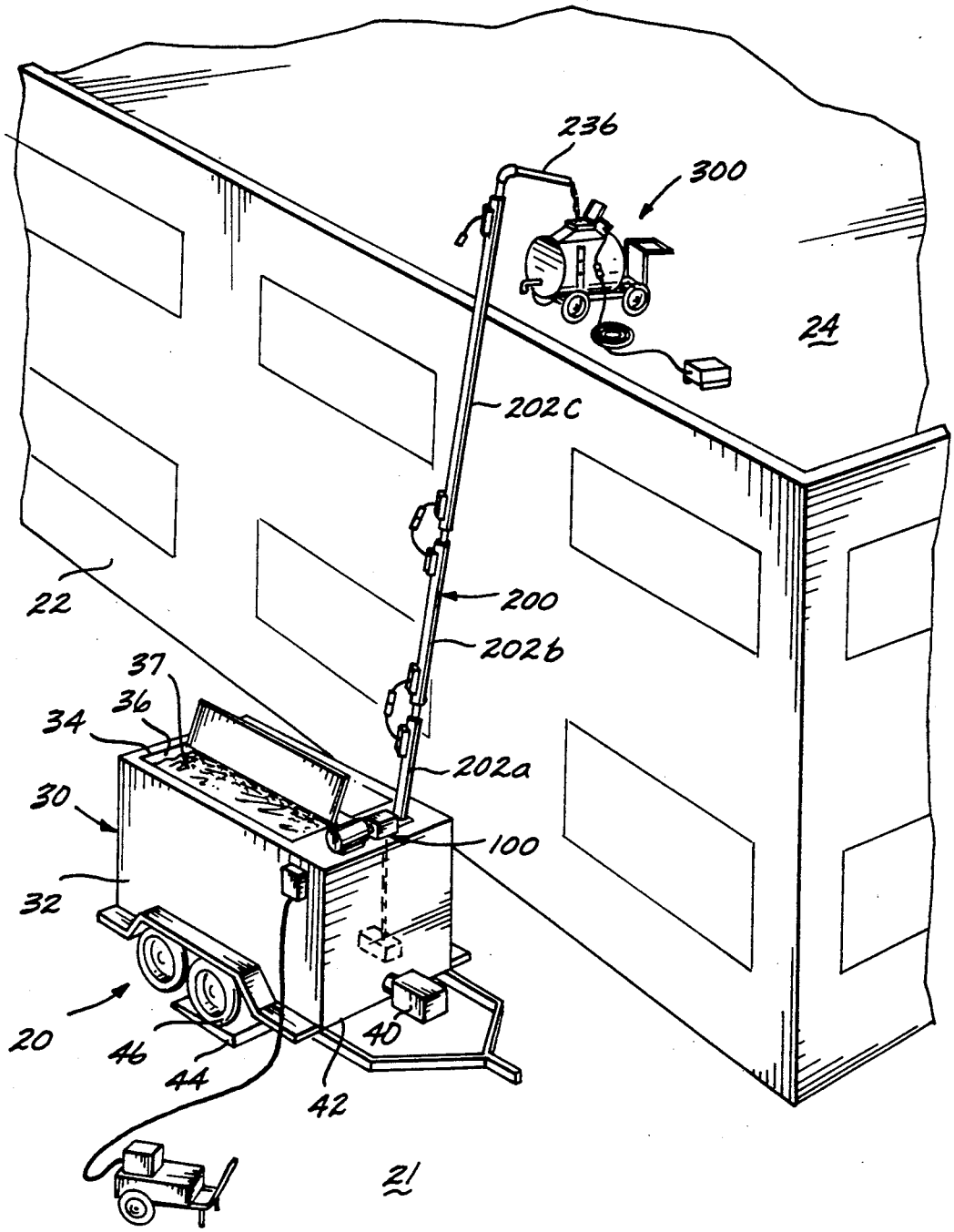
FIG. 1 is an idealized perspective view of a system for transporting liquefied viscous membrane which is made in accordance with the present invention.

Referring to FIG. 1, the present invention is a system 20 for transporting viscous membrane from a first location, typically on the ground 21 adjacent a structure 22 on which the viscous membrane is to be applied, to a second location remote from the first location, for instance the roof 24 of structure 22. Briefly described, system 20 comprises a kettle 30 for storing liquefied viscous membrane, a pump assembly 100 for pumping viscous membrane out of the kettle, a pipe assembly 200 for transporting viscous membrane from the pump to the remote location, and a lugger 300 for transporting viscous membrane dispensed from the pipe assembly to the location on structure 22 where the viscous membrane is to be applied.

Figure 2:
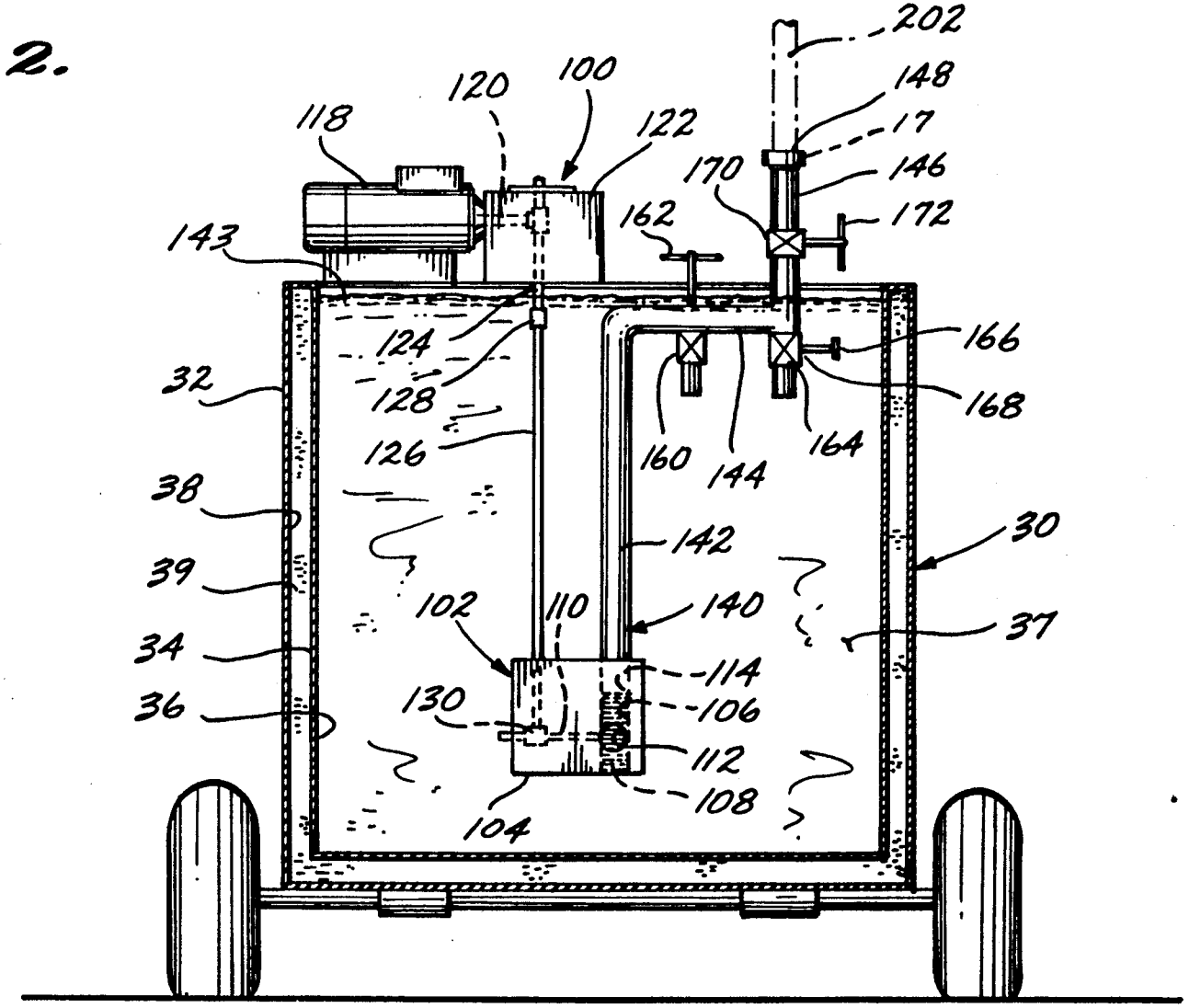
FIG. 2 is a cross-sectional view of the kettle and pump assembly of the system shown in FIG. 1 taken perpendicular to the long axis of the kettle just rearward of the front wall of the chamber of the kettle looking toward the rear wall of the chamber.

Referring to FIGS. 1 and 2, kettle 30 is a conventional kettle of the type widely used in the construction industry to liquefy viscous membrane (which is typically provided by the manufacturer in solid form) and to maintain the liquefied viscous membrane at the temperature at which it is typically applied, i.e., about 375° F. to 425° F. Industrial Waterproof Systems, Ltd., Calgary, Alberta, manufactures a kettle, identified as a Seven-Proof Melter, which may be satisfactorily employed as kettle 30.

Kettle 30 comprises outer walls 32, and inner walls 34 which define the shape and configuration of chamber 36 in which liquefied viscous membrane 37 is stored. Inner walls 34 are spaced inwardly from outer walls 32 so as to form a heat transfer jacket 38 (FIG. 2) therebetween which is filled with an appropriate heat-transfer material 39, such as oil. Kettle 30 includes a heating device 40, such as a gas-fired jet, for heating the heat transfer material 39 disposed in jacket 38. As is known, heat is transferred from the heat transfer material 39 disposed in jacket 38 to viscous membrane located in chamber 36 so as to heat the viscous membrane to a desired temperature.

As discussed in greater detail hereinafter in connection with the description of the operation of system 20, forward end 42 of kettle 30 is elevated slightly, e.g., 2 to 6 inches, relative to the surface 21 on which kettle 30 is positioned. This elevation may be accomplished, for instance by positioning blocks 44 under the leading wheels 46 of kettle 30.

As best illustrated in FIG. 2, pump assembly 100 comprises a conventional impeller assembly 102 comprising a housing 104 having an interior chamber 106 in which an impeller assembly 108 is rotatably supported. Impeller assembly 102 includes a drive shaft 110 coupled to impeller 108 for causing the latter to rotate. Impeller assembly 102 further includes a suction port 112 through which viscous membrane is drawn into chamber 106 and a discharge port 114 through which viscous membrane is discharged from chamber 106. An impeller assembly sold by Viking Pump Company, of Cedar Falls, Iowa, and identified by Model No. KK32, may be satisfactorily employed as impeller assembly 102, except that tungsten bushings should be used for rotatably supporting drive shaft 110 and impeller 108, rather than bronze bushings which are typically supplied with the Model KK32 impeller assembly.

Preferably, impeller assembly 102 is positioned adjacent the front wall of chamber 36, i.e., adjacent the wall of chamber 36 closest to front end 42 of kettle 30. Additionally, impeller assembly 102 is preferably positioned about one foot up from the bottom of chamber 36, assuming the latter is about 3 feet deep.

Pump assembly 100 further comprises an electric motor 118 having an output shaft 120, and a gear reduction box 122 having an output shaft 124. Motor 118 and gear reduction box 122 are preferably mounted on a top surface of kettle 30 adjacent its front end 42 directly above impeller assembly 102. Gear reduction box 122 is coupled with output shaft 120 of electric motor 118 so that rotational drive may be transmitted from output shaft 120 to the gear reduction box. In the preferred embodiment of pump assembly 110, electric motor 118 is a C-face, three horsepower, 1/60/115/230 volt motor. Gear reduction box 122 is a conventional right angle speed reducer which is designed to reduce the rotational speed of output shaft 120 of electric motor 118 to the speed at which it is desired to operate impeller assembly 102, i.e., about 60–100 rpms.

Pump assembly 100 further includes a drive shaft 126 which is coupled with output shaft 124 of gear reduction box 122 by a conventional drive connector 128, such as a Lovejoy connector. Drive shaft 126 extends downwardly in chamber 36 in kettle 30, and the lower end of the drive shaft is coupled with drive shaft 110 of impeller assembly 102 via right angle drive connector 130.

Pump assembly 100 additionally includes an output pipe assembly 140 for transporting viscous membrane discharged by impeller assembly 102 through output port 114 from the output port to a position above kettle 30. Output pipe assembly 140 includes hollow pipe 142, the bottom end of which is coupled with discharge port 114 of impeller assembly 102 and the upper end of which terminates slightly below the normal surface level 143 of viscous membrane 37 stored in chamber 36 of kettle 30. The upper end of pipe 142 is coupled with a horizontally extending pipe 144, which in turn is coupled with a vertically extending upper pipe 146 which terminates at upper end 148, whereby a continuous passageway is provided from output port 114 in impeller assembly 102 to upper end 148 of pipe 146. The latter is sized so that its upper end is positioned above, typically about one foot above, the normal surface level 143 of viscous membrane 37 in kettle 30. Preferably pipes 142, 144 and 146 have an inside diameter of about 2 inches.

Output pipe assembly 140 also includes a bypass valve 160 coupled with horizontally extending pipe 144, which valve extends downwardly into chamber 36 of kettle 30 so as to be positioned below the normal surface level 143 of viscous membrane 37 stored in chamber 36. Bypass valve 160 includes a linkage assembly 162 for opening and closing the valve. Linkage assembly 162 extends above the surface level 143 of the viscous membrane 37 stored in kettle 30 so that bypass valve 160 may be opened or closed without the need to partially drain kettle 30.

Output pipe assembly 140 additionally comprises a pressure relief valve 164 coupled with horizontally extending pipe 144. Pressure relief valve 164 is designed to couple horizontally extending pipe 144 with chamber 36 when the pressure of viscous membrane in pipe 144 adjacent pressure relief valve 164 exceeds a selected level. The pressure of viscous membrane in pipe 144 may exceed the selected level, for instance, in the unlikely event pipe assembly 200 becomes clogged with solidified viscous membrane. Pressure relief valve 164 includes an adjustment mechanism (not shown) for adjusting the point at which the pressure relief will open and couple horizontally extending pipe 144 with chamber 36. This adjustment mechanism is set by rotating a bolt 166 which is coupled therewith in a clockwise direction when it is desired to increase the resistance of the pressure relief valve to opening and in a counterclockwise direction when it is desired to decrease the resistance of the pressure relief valve to opening. Pressure relief valve 164 includes a lock nut 168 threadably disposed on bolt 166 for locking the bolt in position once the cutout point of the adjustment mechanism of the pressure relief valve has been selected.

As shown in FIG. 2, pressure relief valve 164 is positioned below the normal surface level 143 of viscous membrane 37 in chamber 36. As such, chamber 36 must be partially drained to permit pressure relief valve 164 to be adjusted. Alternatively, pressure relief valve 164 may be positioned so that its adjustment bolt 166 may be adjusted without lowering the level of viscous membrane in chamber 36.

Upper pipe 146 includes a valve 170 for opening and closing the upper pipe. Valve 170 includes a handle 172 for causing the valve to open and close. Upper pipe 146 also includes one half 174 of a two-part pipe coupler union attached to upper end 148 of the upper pipe. Union half 174 is designed to matingly engage the pipe coupler unions on the ends of the pipe sections 202 of pipe assembly 200, as discussed in greater detail hereinafter.

Figure 3:
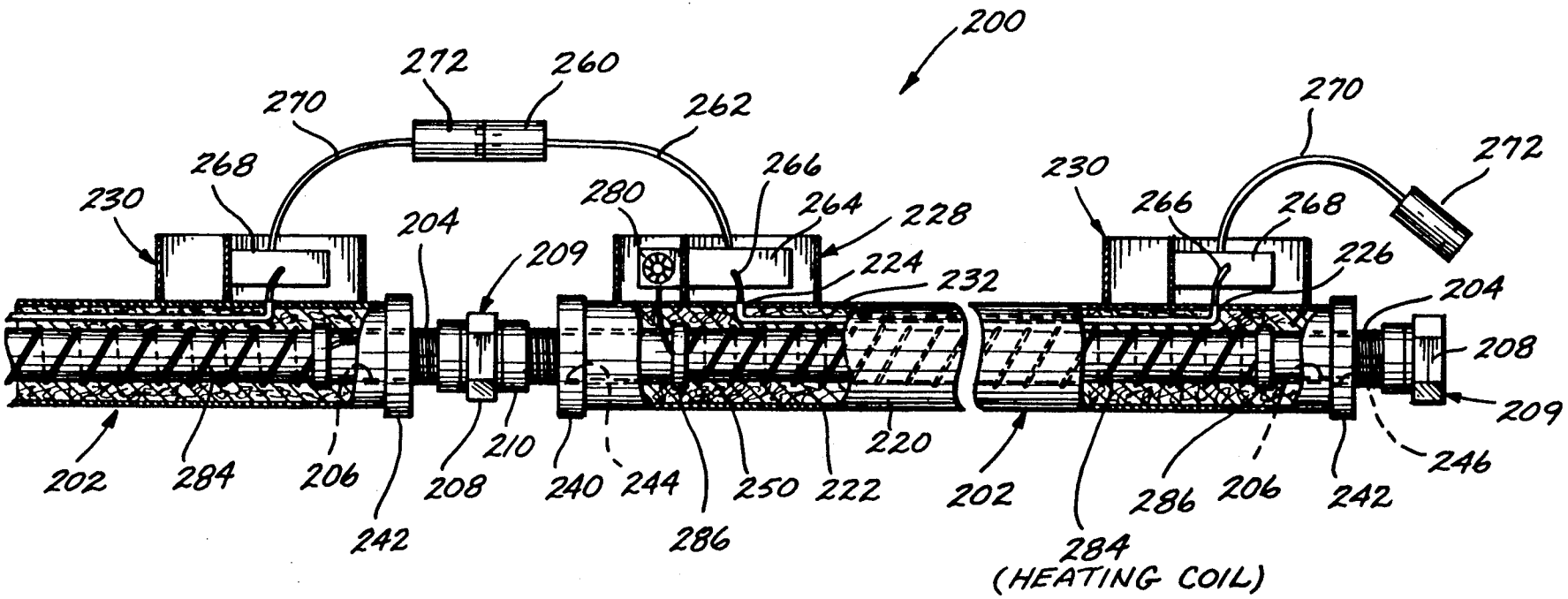
FIG. 3 is a side elevation view of one entire pipe section of the pipe assembly, and a portion of another pipe section attached to one end of the entire pipe section, the one entire pipe section being partially broken away to reveal internal structural elements thereof.
Figure 4:
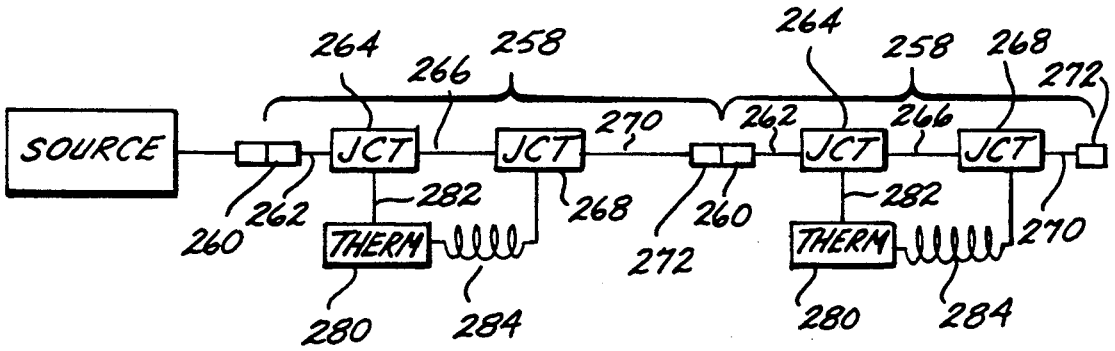
FIG. 4 is a schematic wiring diagram of two coupled pipe sections of the pipe assembly.

Referring to FIGS. 1, 3 and 4, pipe assembly 200 comprises a plurality of discrete pipe sections 202 which are coupled together so as to form a continuous passageway from pump assembly 100 to a remote location where the viscous membrane is discharged, as discussed in greater detail hereinafter. Preferably, the overall length of pipe sections 202 ranges from 3 to 30 feet. For instance, as illustrated in FIG. 1 pipe section 202*a* has a length of 5 feet, pipe section 202*b* has a length of 10 feet and pipe section 202*c* has a length of 20 feet.

As best illustrated in FIG. 3, each pipe section 202 comprises an inner pipe 204 having a central bore 206 extending entirely therethrough so that the inner pipe is open at both ends. Inner pipe 204 is preferably made from steel, and the diameter of central bore 206 preferably ranges from 1.5 to 2.5 inches, ideally about 2 inches. The outer surface of inner pipe 204 is threaded adjacent its ends and one half 208 of a pipe coupler union 209 is threadably attached to the threaded outer surface portion at one end of inner pipe 204, and the other half 210 of the pipe coupler union is threadably attached to the threaded outer surface at the opposite end of inner pipe 204. In an exemplary embodiment of the present invention, inner pipes 204 were made from schedule 40 2-inch steel pipe, and pipe coupler unions 209 were 2-inch schedule 80 pipe coupler unions.

Pipe section 202 additionally comprises outer pipe 220 which surrounds inner pipe 204. Outer pipe 220 has a central bore 222 extending entirely therethrough, whereby the outer pipe is open at both ends. Pipe sections 202 are preferably about 1 foot shorter than the inner pipe 204 they surround so as to permit a 6 inch long portion of each end of the inner pipe to project beyond the associated end of the outer pipe. In a preferred embodiment of the present invention, outer pipe 220 is made from aluminum tubing having an inside diameter of about 5 inches. Such tubing is of the type widely used in irrigation systems. Inner pipe 220 includes an aperture 224 extending through the sidewall thereof adjacent one end of the outer pipe, and an aperture 226 extending through the sidewall of the outer pipe adjacent the opposite end thereof. Outer pipe 220 also includes a box 228, preferably made from aluminum sheet metal, attached to the outer surface of the outer pipe adjacent the end thereof in which aperture 224 is located so that the aperture is positioned within the sidewalls of box 228. Outer pipe 220 includes a similar box 230 attached to the outer surface of the opposite end of the outer pipe so that aperture 226 is positioned within the sidewalls of box 230. A hollow conduit 232 is positioned within central bore 222 of outer pipe 220 and runs along the length of the outer pipe. The ends of hollow conduit 232 are coupled with apertures 224 and 226 in the sidewall of pipe 220.

As illustrated in FIG. 1, pipe assembly 200 may include a short discharge pipe 236 which is adapted to be attached to the upper end of the pipe assembly.

Pipe section 202 includes plates 240 and 242 for supporting inner pipe 204 in central bore 222 of outer pipe 220 so that the inner and outer pipes are positioned in fixed concentric relation to one another. Plate 240 is attached to one end of outer pipe 220 and plate 242 is attached to the other end of the outer pipe. Plate 240 includes a circular, centrally positioned bore 244, and plate 242 includes a circular, centrally positioned bore 246. Bores 244 and 246 have a diameter which is just slightly larger than the outside diameter of inner pipe 204 so that when the latter is positioned to extend through bores 244 and 246, the inner pipe will be substantially prevented from moving radially relative to end plates 240 and 242, and hence relative to outer pipe 220.

Pipe section 202 further comprises insulation 250 which is positioned in the space between the outer surface of inner pipe 204 and the inner surface of outer pipe 220. Preferably, insulation 250 is fiberglass bat insulation having a thickness of about one inch. Fiberglass insulation of the type manufactured by Johns-Mansville Corporation and identified by the mark Micro Lok may be satisfactorily employed as insulation 250, although other types of insulation may also be used so long as the insulation has the ability to maintain its insulating properties in an environment having a temperature of at least 500° F.

As best illustrated in FIGS. 3 and 4, pipe section 202 includes a heating system 258 for maintaining the temperature of viscous membrane positioned in central bore 206 of inner pipe 204 at a selected level in the temperature range of 375° F. to 425° F.

Heating system 258 includes a male electrical plug 260 and a short length of electrical cable 262, one end of which is attached to plug 260. Preferably, cable 262 has a length of about one foot. The other end of cable 262 is connected to junction box 264. Junction box 264 is positioned in sheet metal box 228 positioned at one end of outer pipe 220. Heating system 258 also includes electrical cable 266 which extends down through aperture 224 in outer tube 220, is positioned in and extends along the length of hollow conduit 232, and extends up through aperture 226 at the opposite end of outer pipe 220. The end of cable 266 extending up through aperture 224 is coupled with cable 262 in junction box 264, and the end of cable 266 extending through aperture 226 is coupled via junction box 268 with one end of cable 270. The other end of cable 270 is attached to female plug 272. Preferably cable 270 has a length of about one foot. Junction box 268 is positioned in sheet metal box 230 attached to outer pipe 220 adjacent aperture 226, and cable 270 and female plug 272 extend beyond box 230.

Heating system 258 additionally includes as thermostat 280 which is coupled with cable 262 at junction box 264 via line 282 (FIG. 4). Watlow Co. manufactures a thermostat identified as Type III, 175-550F SP STAT which may be satisfactorily employed as thermostat 280.

Heating assembly 258 also comprises a heating coil 284, one end of which is connected to thermostat 280 and the other end of which is coupled with cable 270 at junction box 268. Heating coil 284 is wrapped around the outer surface of inner pipe 204 so that spacing between adjacent wraps of the coil is about 2 inches. Thus, for a given pipe section 202, heating coil 284 is typically at least twice as long as the inner pipe 204 of the pipe section. Heating coil 284 must be capable of generating sufficient heat to cause viscous membrane positioned in central bore 206 of inner pipe 204 to remain at a temperature of between 375° F. and 425° F. In this connection, it has been determined that the length of heating coil 284 wrapped around a one-foot long section of inner pipe 204 should be capable of generating a heat output of about 40–60 watts. Pyrotenax Co. manufactures heat tracer cables which may satisfactorily be employed as heating coils 284. One such heat tracer cable which may be satisfactorily used with pipe section 202 having a length of 20 feet is identified by Pyrotenax Co. as Model No. D/1952/40/1440/140/1/14/X. Conventional stainless steel straps 286 are used to secure heat coil 284 to inner pipe 204.

All of the components of heating assembly 258 are designed to operate with electrical power supplied at 240 Volts.

Figure 7:
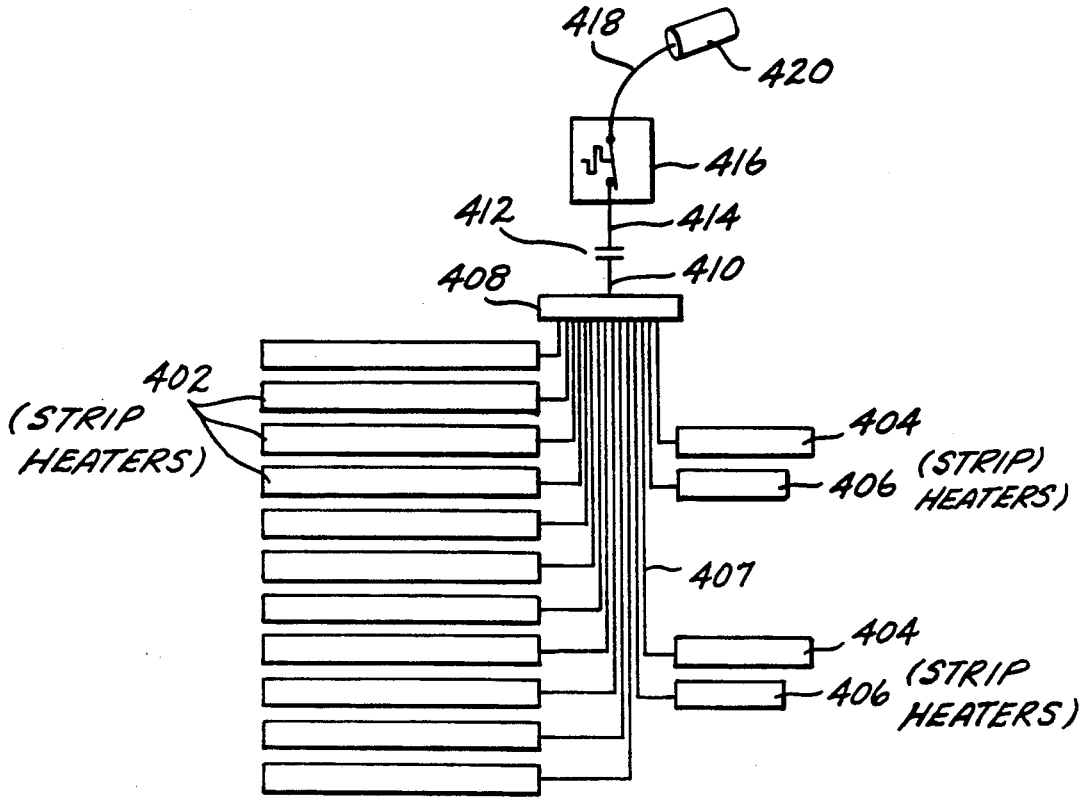
FIG. 7 is a wiring diagram for the tank assembly of the lugger.
Figure 5:
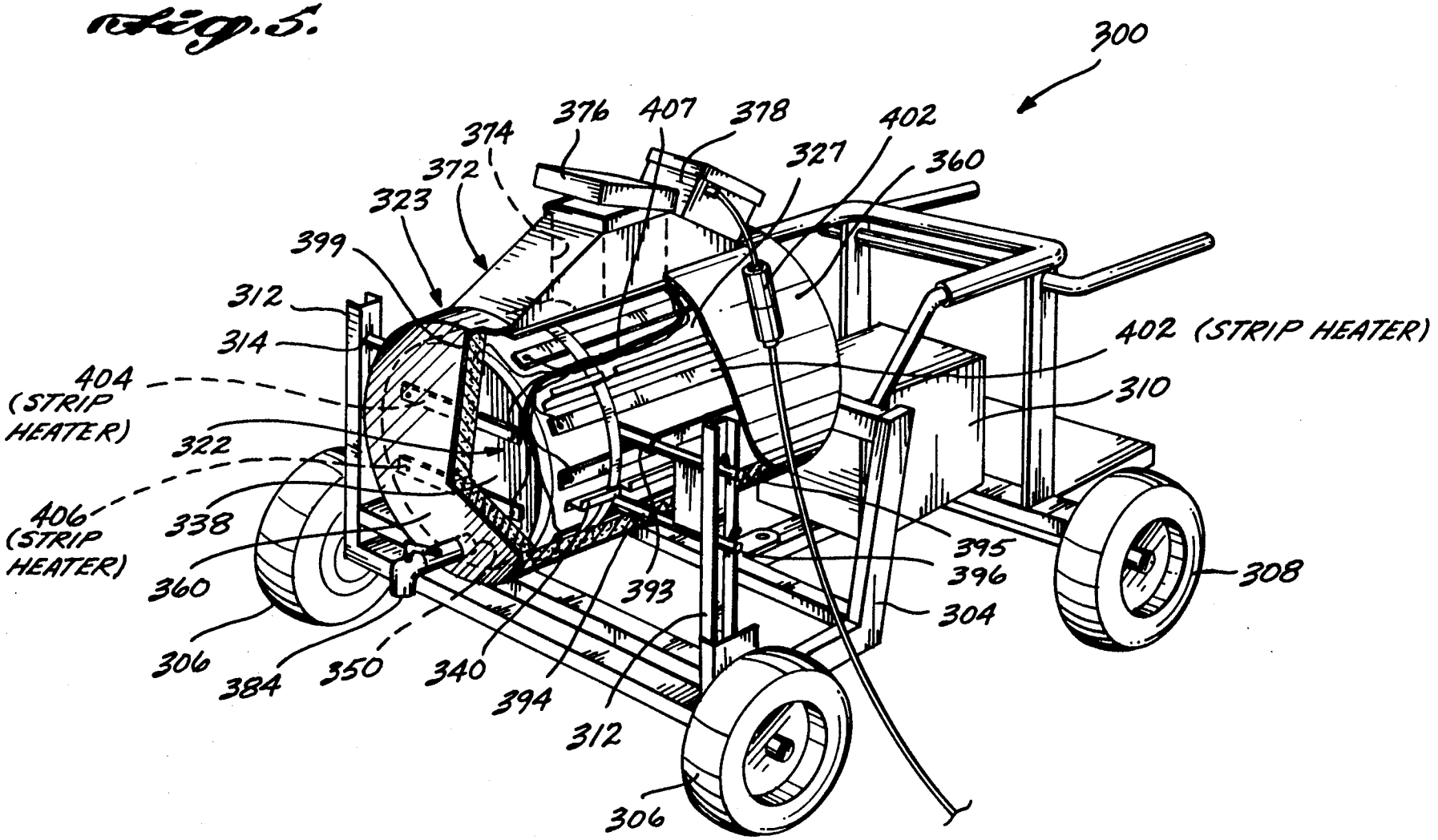
FIG. 5 is a perspective view of the lugger of the present invention, with portions of the outer housing of the lugger tank assembly being broken away to reveal internal features of the tank assembly.
Figure 6:
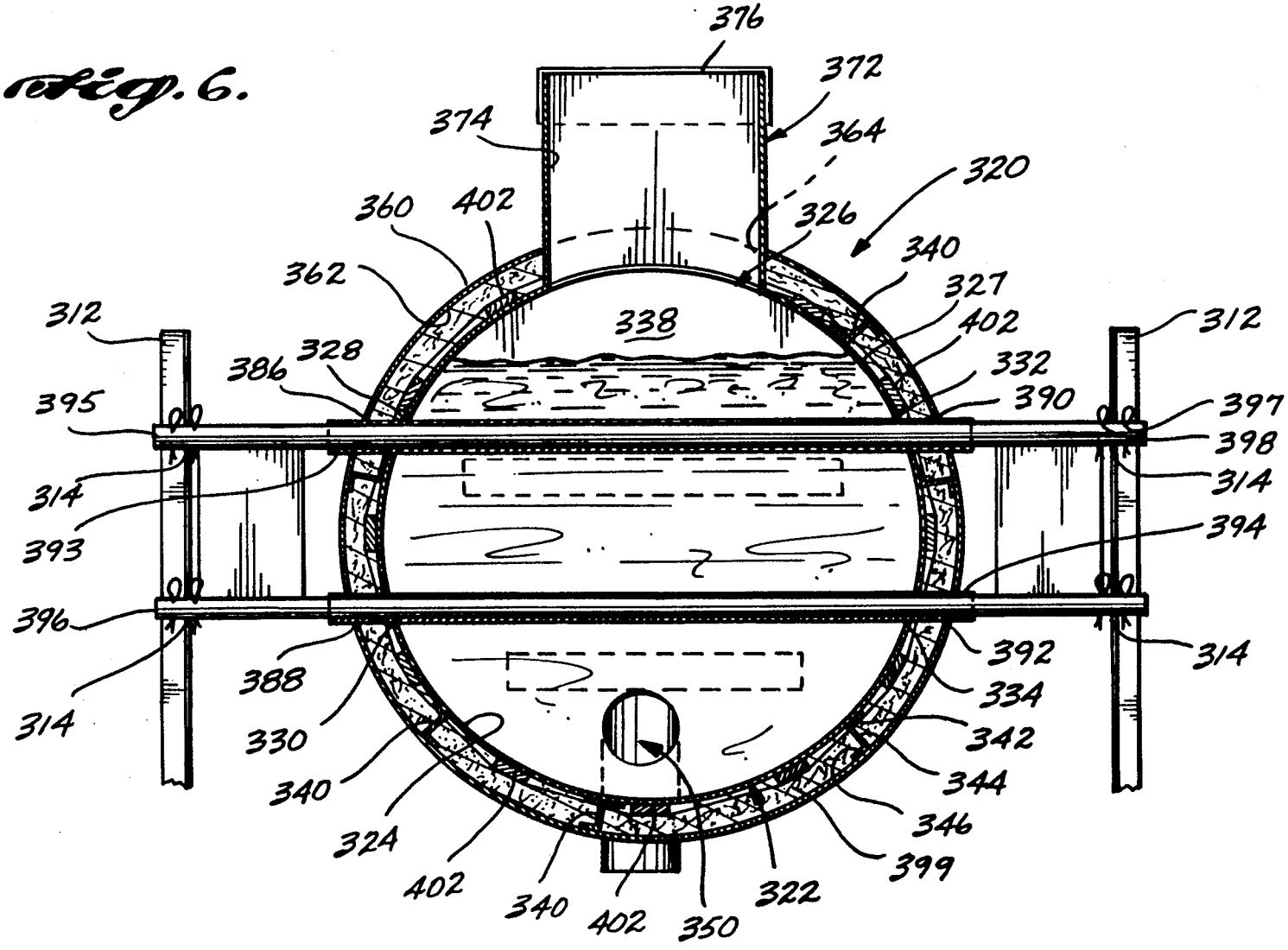
FIG. 6 is a cross-sectional view of the lugger tank assembly looking toward the front end of the assembly and taken along a plane extending perpendicular to the long axis of the tank assembly and intersecting the hollow pipes which extend through the tank assembly.

Referring to FIGS. 5-7, lugger 300 comprises a motorized cart 302 having a frame 304, front wheels 306, rear wheels 308, and motor 310 for driving the rear wheels 308. Cart 302 comprises a pair of vertically extending support members 312 attached to frame 304. Vertically extending members 312 are positioned adjacent the front end of cart 302. Each vertical support 312 includes two apertures 314 extending therethrough, the latter being spaced about 9 inches from one another. Garlock West Equipment Company of Hayward, Calif. manufactures a cart identified as an R-800 Workhorse which may satisfactorily be employed as cart 302.

Lugger 300 additionally includes tank assembly 320 for storing a predetermined quantity of viscous membrane and for maintaining the viscous membrane at a temperature in the range of 375° F. to 425° F. Tank assembly 320 includes an inner tank 322 having an inner chamber 324 (FIG. 6) for storing viscous membrane. In a preferred embodiment of lugger 300, tank 322 has an elongate cylindrical configuration, has a length of about 36 inches, and is sized so that about 50 gallons of liquefied viscous membrane may be stored in chamber 324. Tank 322 includes an aperture 326 (FIG. 6) extending through an upper portion of the sidewall 327 of the tank. Inner tank 322 additionally includes circular bores 328 and 330 extending through the sidewall 327 on one side of tank 322 and circular bores 332 and 334 extending through the sidewall on an opposite side of tank 322. Bore 332 is positioned opposite bore 328 and bore 334 is positioned opposite bore 330.

Inner tank 322 includes a rear wall (not shown) and a front wall 338 (FIG. 6) which are attached to opposite ends of sidewall 327.

Inner tank 322 additionally comprises elongate spacers 340. The latter have Z-shaped cross-sectional configuration, and are attached in circumferentially spaced relation to the outer surface of sidewall 327 of tank 322 so that the long axes of the spacers 340 extend parallel to the long axis of tank 322. Each spacer 340 includes a base portion 342, a web portion 344 and a top portion 346, with the spacer being formed so that bottom portion 342 and top portion 346 extend in parallel and are spaced apart from one another about 1.5 inches. Preferably, a spacer 340 is positioned about every 45° around the circumference of the outer surface of tank 322.

Inner tank 322 additionally includes a circular aperture 350 extending through front wall 338 of tank 322 adjacent the bottom end of the front wall.

Tank assembly 320 further comprises an outer housing 360 having an interior chamber 362 (FIG. 6). Outer housing 360 has an elongated cylindrical configuration and is sized so that tank 322 may be received in interior 362 of outer housing 360 with a close sliding fit. More specifically, outer housing 360 is sized so that when tank 322 is positioned in the interior 362 of the outer housing, top portions 346 of spacers 340 will contact the inner surface of the outer housing. The latter includes an aperture 364 extending through the top portion of the sidewall 365 thereof. Aperture 364 is aligned with aperture 326 in inner tank 322, and the size and configuration of aperture 364 is substantially identical to that of aperture 326. Outer housing 360 additionally comprises a front wall 366 and a rear wall (not shown) which are attached to opposite ends of sidewall 365. Outer housing 366 also includes a circular bore (not shown) in front wall 366 at the bottom end thereof which is aligned with circular aperture 350 in inner tank 322. Preferably, the diameter of the circular aperture in front wall 366 is identical to the diameter of circular aperture 350.

Outer housing 360 includes an upstanding section 372 attached to the upper surface of the outer housing. Section 372 includes a passageway 374 which couples aperture 326 in tank 322 with aperture 364 in outer housing 360 and extends a predetermined distance, e.g., about 8 inches, above the top surface of the outer housing. The top and bottom ends of passageway 374 are open so as to permit viscous membrane to be dispensed into chamber 324 in tank 322. Section 372 additionally includes a pivotally mounted lid 376 for closing off the upper end of passageway 374 except when it is desired to add viscous membrane to chamber 324. Section 372 additionally includes a box 378 for housing certain components of the heating system 400 of lugger 300, as discussed hereinafter.

Tank assembly 320 additionally includes a valve 384 coupled with aperture 350 in inner tank 322 and the corresponding aperture in the front wall 366 in outer housing 360 for use in dispensing viscous membrane from chamber 324. preferably, valve 384 is a so-called "molasses" valve.

Outer housing 360 includes bores 386, 388, 390, and 392. Bores 386, 388, 390, and 392 correspond in size and configuration, respectively, to bores 328, 330, 332, and 334 in tank 322. In addition, bores 386, 388, 390, and 392 are aligned, respectively, with bores 328, 330, 332, and 334.

Outer housing 360 includes pipes 393 and 394. The former has a length slightly greater than the outside diameter of outer housing 360 and is positioned in bores 328, 322, 386, and 390 so as to extend through the interior of chamber 324 and is secured to the sidewall of inner tank 322 and outer housing 360. Pipe 394 is identical in length to pipe 393, is positioned in bores 330, 334, 388, and 392, and is secured to the sidewall of inner tank 322 and outer housing 360. Bores 328-334 and 386-392 are positioned such that pipe 393 extends parallel to and is spaced from pipe 394.

Tank assembly 320 also includes rods 395 and 396 which are positioned, respectively, in the hollow interiors of pipes 393 and 394. Rods 395 and 396 are sized such that they make a close sliding fit in the interiors of the pipes in which they are positioned, and such that the ends of the rods project beyond the ends of pipes in which they are positioned. Rods 395 and 396 each include two small bores 397 and 398 in each projecting end thereof. Bores 397 and 398 extend normally to the longitudinal axes of the rods and are spaced about 1 inch from one another.

Tank assembly 320 is supported by support members 312 of cart 302. More specifically, rods 395 and 396 are positioned to extend through apertures 314 in support members 312 so that a support member is positioned between each pair of apertures 397 and 398 provided in the ends of the rods. Cotter pins or other fasteners are then inserted through the apertures 397 and 398 to prevent the rods 395 and 396 from moving relative to the support members 312. Thus, tank assembly 320 hangs from pipes 393 and 394 and the rods 395 and 396 received therein.

Tank assembly 320 additionally comprises insulation 399 which is positioned in the space between the outer surface of tank 322 and the inner surface of outer housing 360. Insulation 399 is preferably rock wool blanket insulation having a thickness of about one and one-half inches, having the ability to withstand temperatures of up to 1,000° F., and having an insulation value of about R6.

Tank assembly 320 additionally includes heating assembly 400. The latter includes a plurality of elongate strip heaters 402 which are attached to the outer surface of tank 322 so that the long axes of the strip heaters extend parallel to the long axis of tank 322. Strip heaters 402 are positioned around the circumference of the outer surface of tank 322 so that each strip heater is spaced about 30° from adjacent strip heaters. Because a strip heater 402 is not positioned on the upper surface of tank 322 due to the presence of passageway 374, 11 strip heaters are preferably attached to the outer surface of tank 322. In a preferred embodiment of the invention, strip heaters 402 are about 30.5 inches long and each has a heat output of about 750 watts. Heating assembly 400 additionally includes two strip heaters 404 and two strip heaters 406. One of strip heaters 404 and 406 is attached to front wall 338 of tank 322 and the other of strip heaters 404 and 406 is attached to the rear wall (not shown) of tank 322. In a preferred embodiment of heater assembly 400, strip heaters 404 have a length of about 15 inches and a heat output of about 325 watts and strip heaters 406 have a length of about 12 inches and a heat output of about 250 watts.

As illustrated in FIG. 7, strip heaters 402, 404, and 406 are electrically connected via lines 407 to thermocouple 408 which is connected via line 410 to contact relay 412. The latter is connected via line 414 to thermostat 416. The latter is coupled via cable 418 to male plug 420. Thermocouple 408, relay switch 412, and thermostat 416 are all positioned in box 378 attached to section 372 of tank assembly 320. Cable 418 extends through a sidewall of box 378 and hangs freely, along with plug 420, next to box 378.

All the components of heater assembly 400 are designed to operate with electrical power provided at 440 volts. In addition the size, number, and heat generating capacity of strip heaters 402, 404 and 406 may be modified as desired so long as the total heat output of these strip heaters is such that liquefied viscous membrane positioned in chamber 324 and inner tank 322 may be maintained at a temperature of between about 370° F. to 425° F.

Figure 8:
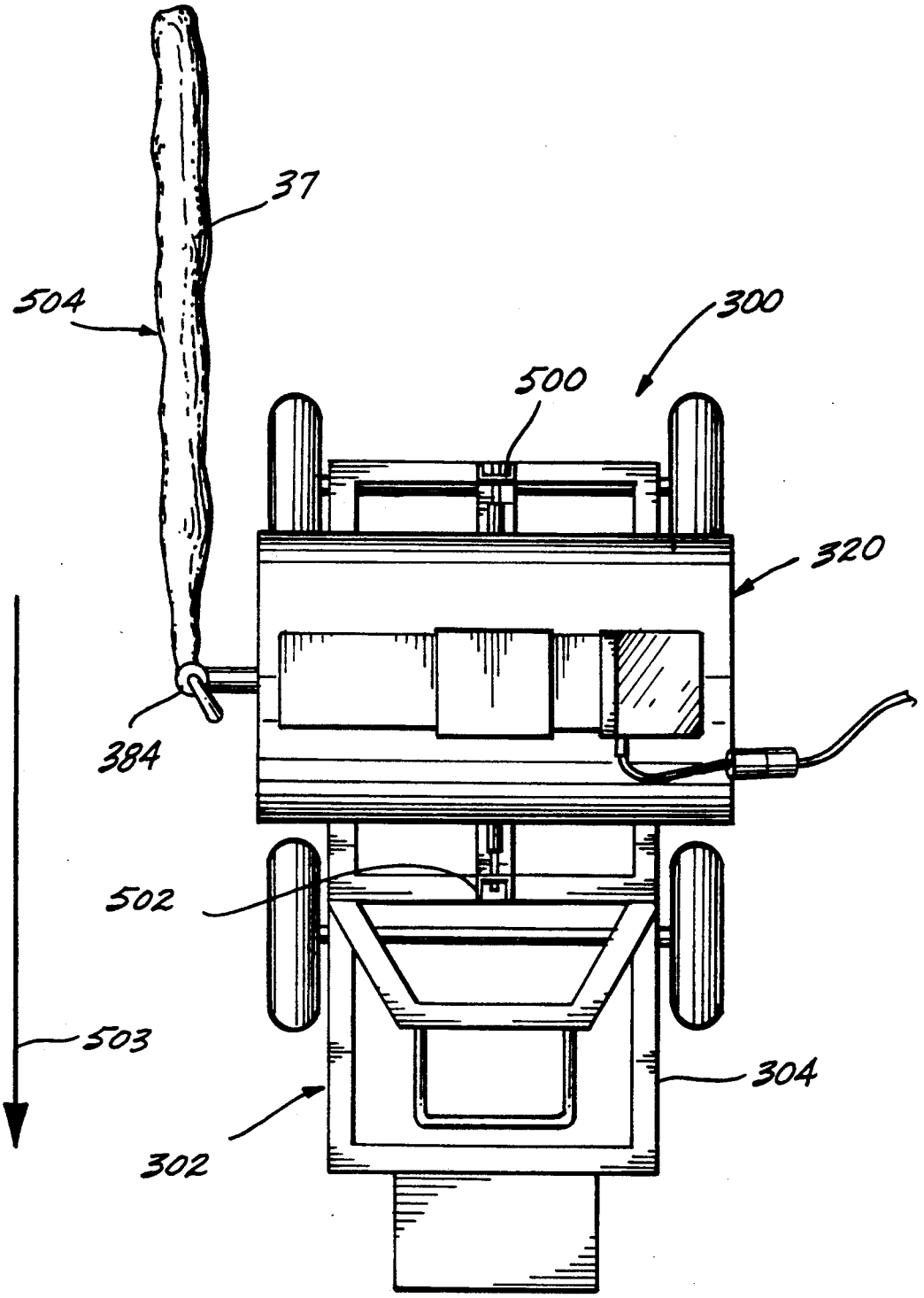
FIG. 8 is a schematic plan view of an alternative embodiment of the lugger.

Referring to FIGS. 5–8, lugger 300 is designed to dispense viscous membrane from tank assembly 320 adjacent the front end of the lugger, as discussed in greater detail hereinafter. However, under certain circumstances, it may be desirable to dispense viscous membrane from tank assembly 320 adjacent one side of lugger 300. The embodiment of lugger 300 illustrated in FIG. 8 is designed to permit such side discharge of viscous membrane. The embodiment of lugger 300 illustrated in FIG. 8 is identical to the embodiment of the lugger illustrated in FIG. 5, except that tank assembly 320 is positioned so that its long axis extends parallel to the rotational axes of wheels 306 and 308 of lugger 300, rather than perpendicular to the rotational axes of the wheels as is the case with the embodiment of the lugger illustrated in FIG. 5.

To achieve this sideways mounting of tank assembly 320, lugger cart 302 is modified to include upstanding support members 500 and 502 which are attached to frame 304 of the cart. Support members 500 and 502, which are provided in place of support members 312, are positioned adjacent the front end of the cart 302 so that a vertical plane extending through members 500 and 502 extends parallel to the longitudinal axis of cart 302, rather than perpendicular to the longitudinal axis as is the case with a vertical plane extending through supports 312. Tank assembly 320 is attached to supports 500 and 502 in exactly the same manner that the tank assembly is attached to supports 312 of the embodiment of the lugger illustrated in FIG. 5, as described above. By this positioning of tank assembly 320 on cart 302, discharge valve 384 is positioned laterally outward of the outermost portion of the left side of cart 302, as illustrated in FIG. 8.

In connection with the following description of the operation of system 20 of the present invention, reference should be made to FIGS. 1–8. Initially, kettle 30 is positioned on surface 21 adjacent the structure 22 having a surface 24 on which the viscous membrane is to be applied. For the purposes of this description, it is assumed that surface 24 is the roof of structure 22, and the roof is positioned several stories above surface 21. Front end 42 of kettle 30 is elevated slightly, e.g., about 2–6 inches, by placing blocks 44 under front wheels 46 of kettle 30. Next, pipe assembly 200 is built up by attaching a plurality of pipe sections 202 together using coupling unions halves 208 and 210 positioned at the ends of the pipe sections so that the central bores 206 of the pipe sections are in mutual communication and define a pathway along which viscous membrane may be transported. During this set-up of pipe assembly 200, one end of the bottommost pipe section 202 of the assembly is coupled with the upper end 148 of pipe 146 of output pipe assembly 140 via union half 172 on the pipe 146. As a consequence of this coupling, the central bores 206 of pipe sections 202 are coupled with output pipe assembly 140. The upper end of pipe assembly 200 is positioned at a convenient discharge location adjacent the surface 24 on which the viscous membrane is to be applied. Preferably the upper end of pipe assembly 200 is positioned about 5 feet above surface 24 so as to permit the tank assembly 320 of lugger 300 to be positioned beneath discharge pipe 236 which is attached to the upper end of pipe assembly 200. Conventional rigging techniques may be required to secure pipe assembly 200 in fixed relation between pump assembly 100 and the discharge location on structure 22. Because the pipe sections 202 making up pipe assembly 200 differ in length, by appropriate selection of pipe sections 202, a pipe assembly may be built up which terminates in an optimal location.

Pipe assembly 200 is assembled so that the end of a given pipe section 202 adjacent to which a male plug 260 is located is coupled with the end of a adjacent pipe section 202 on which a femal plug 272 is located. Next, the thermostat 280 for each plug section 202 is adjusted so that the heating coil 284 coupled therewith generates a quantity of heat sufficient to maintain viscous membrane positioned in central bore 206 of inner pipe 204 at a selected temperature in the range of 370° F. to 425° F. Because electrical power is carried directly from one pipe section to the next via cable 266, the thermostats of the various pipe sections are free to operate independently of one another. This feature is particularly advantageous when pipe assembly 200 is sufficiently long that viscous membrane transported through the pipe assembly will begin to cool as it reaches the upper end of the pipe assembly. When this latter condition occurs, the thermostats 280 controlling the temperature of heating coils 284 of the upper pipe sections will tend to remain closed, i.e., will conduct power to the heating coils, for a longer period of time than thermostats associated with lower pipe sections. Consequently, viscous membrane located in the central bore 206 of the upper pipe sections will remain at the same temperature as viscous membrane located in the lower pipe sections, i.e., a selected temperature in the range of about 375° F. to 425° F.

Then, chamber 36 of kettle 30 is filled with solid viscous membrane. The latter is typically provided in solid circular blocks having a diameter of about 2 feet and a thickness of 6 inches. Typically, the blocks are wrapped in plastic sheet material. In most cases, the solid blocks of viscous membrane are positioned in kettle 30 without removing their plastic covering.

Thereafter, bypass valve 160 is closed and valve 170 in pipe 146 is opened. In addition, pressure relief valve 164 is adjusted so that it will open when the pressure of viscous membrane positioned in horizontally extending pipe 144 and contacting the pressure relief valve exceeds a selected level. This adjustment will vary as a function of the total length of pipe assembly 200. Such adjustment is effected by appropriate manipulation of adjustment bolt 166 on pressure relief valve 164. When pressure relief valve 164 opens, liquefied viscous membrane delivered by pump assembly 100 is transferred back to kettle 30. Typically, pressure relief valve 164 will open only when viscous membrane solidifies and blocks the central bore 206 of pipe assembly 200.

Next, heating device 40 is activated so as to elevate the temperature of the heat transfer medium 39 in jacket 38 to a temperature sufficient to cause the solid blocks of viscous membrane positioned in chamber 36 in kettle 30 to melt. Such melting typically occurs at about 200° F. This heating is continued until the viscous membrane reaches a selected temperature in the range of 375° F. to 425° F. Preferably chamber 36 is substantially entirely filled with viscous membrane so that the surface level 143 of the viscous membrane 37 in chamber 36 is such that bypass valve 160 and pressure relief valve 164 of output pipe assembly 140 are immersed in the viscous membrane.

Then, lugger 300 is driven across surface 24 so that the lid 376 of its tank assembly 320 is positioned directly below the upper end of the discharge pipe 236. of pipe assembly 200. Then, lid 376 is open so that viscous membrane dispensed from the upper end of pipe assembly 200 is free to flow through passageway 374 in upstanding section 372 and into chamber 324 of inner tank 322.

Next, pump assembly 100 is activated so as to cause viscous membrane to be pumped from chamber 36 up into and through pipe assembly 200. This activation is achieved by coupling electric motor 118 with a source of power so as to cause the output shaft 120 of the motor to rotate. Typically, a switch (not shown) is provided adjacent the discharge location of pipe assembly 200 so that the pump motor 118 may be turned on and off at the discharge location. Rotational drive is then transmitted from output shaft 120 of motor 118 through gear reduction box 122 to the output shaft 124 of the gear reduction box. The speed at which motor 18 is operated, and the extent of speed reduction provided by gear reduction box 122, is selected so that output shaft 124 of gear reduction box 122 will rotate at about 80 rpms. Rotation of output shaft 124 is transmitted via connector 128, drive shaft 126, and right angle connector 130 to drive shaft 110 of impeller assembly 102 so as to cause the drive shaft 110 to rotate. This rotation is transmitted from the drive shaft 110 to impeller 108, causing the latter to rotate and draw viscous membrane in chamber 36 in through suction port 112 and to discharge the viscous membrane through discharge port 114.

Viscous membrane discharged through port 114 then travels through pipe 142, horizontally extending pipe 144, upper pipe 146 and into central bore 206 of inner pipe 204 of the bottommost pipe section 202. As noted above, the bottommost pipe section 202 is coupled with upper pipe 146. With continued operation of pump assembly 100, the viscous membrane in the central bore 206 of the lowest pipe section 202 is driven upwardly into and through the central bores 206 of the other pipe sections 202 making up pipe assembly 200. Eventually, liquefied viscous membrane will begin flowing out of the discharge pipe 236 at the upper end of pipe assembly 200 and into the inner tank 322 of lugger 300. So long as pump assembly 100 is activated, viscous membrane will continue to flow through pipe assembly 200 and into lugger 300. When it appears that the inner tank 322 of lugger 300 is nearly full, motor 118 is deactivated. System 20 is designed so that viscous membrane in pipe assembly 200 does not flow back into kettle 30 when the pump assembly 100 is deactivated.

About one-half hour prior to the time viscous membrane is to be first pumped through pipe assembly 200, plug 420 of the heater assembly 400 of lugger 300 is coupled with a source of electrical power so as to cause strip heaters 402, 404, and 406 attached to the outer surface of the inner tank 322 of the lugger to heat the interior of the inner tank to a selected temperature in the range from 375° F. to 425° F. The selected temperature is obtained by appropriate adjustment of thermostat 416. After the lugger has been filled with viscous membrane, plug 420 is disconnected from the source of power and lugger 300 is driven along surface 24 to the location where it is desired to apply the viscous membrane. Such application is typically effected by dispensing liquid membrane from tank assembly 320 by opening molasses valve 384 and allowing viscous membrane to flow onto the surface on which it is to be applied. The viscous membrane is then spread out to a desired thickness using known spreader tools and techniques. Under certain circumstances it may be desirable to dispense viscous membrane from lugger 300 via valve 384 into buckets or other containers and then transport the viscous membrane to the specific location on surface 24 where it is to be applied. In other circumstances it may be desirable to use the embodiment of lugger 300 illustrated in FIG. 8, which is designed to dispense viscous membrane stored therein adjacent one side of the lugger. With the side-discharge embodiment of lugger 300, molasses valve 384 is opened and then lugger 300 is driven slowly in the direction indicated by arrow 503 so that a row 504 of viscous membrane 37 is dispensed on surface 24. Then, the row is spread out to a desired thickness using known tools and techniques.

If lugger 300 is continuously receiving viscous membrane from pipe assembly 200, transporting the viscous membrane to a selected location on surface 24, dispensing the liquid membrane at such location, and then returning to pipe assembly 200, it is typically unnecessary to couple heating assembly 400 with a source of electrical power. However, if viscous membrane is stored in lugger tank assembly 320 for more than about 15 minutes, the heating assembly 400 of the tank assembly 320 must typically be coupled with a source of power so as to maintain the liquefied viscous membrane in the tank assembly at the selected temperature in the range from 375° F. to 425° F., and to prevent the viscous membrane from solidifying on the inner surface of tank 322.

Although lugger 300 has been described as an integral component of system 20 of the present invention, it is to be appreciated that lugger 300 may be used separate and apart from the other components of system 20. For instance, it may be desirable to use lugger 300 even when kettle 30 is positioned on the surface 24 on which the viscous membrane is to be applied. Lugger 300 may also be used for transporting hot, liquefied materials other than viscous membrane.

Although in the description of the operation of system 20 set forth above, surface 24 in which viscous membrane is applied was described as being positioned above kettle 30, it is to be appreciated that pipe assembly 200 may be positioned to extend horizontally, or even downwardly.

Although the system 20 of the present invention has been described as designed for storing and transporting viscous membrane, it is to be appreciated that liquefied materials having a viscosity lower than that of viscous membrane and a temperature below about 450° F. may also be satisfactory stored and transported by system 20. For instance, system 20 may be used to store and transport conventional roofing asphalt from kettle 30 to the surface on which the roofing asphalt is to be applied.

Although the height to which pump assembly 100 and pipe assembly 200 may transport viscous membrane has not been established, it is believed that the pump and pipe assemblies are capable of transporting viscous membrane to a height of at least 300 feet. When the discharge end of pipe assembly 200 is positioned at about the same level as kettle 30, or is positioned below kettle 30, it is believed that pump assembly 100 and pipe assembly 200 are capable of transporting viscous membrane distances well in excess of 300 feet.

It is preferred that impeller assembly 102 be positioned near the bottom of chamber 36 in kettle 30 so that the viscous membrane drawn into the impeller assembly is thoroughly heated and completely liquefied. In this connection, it is believed that of the viscous membrane in the upper portions of chamber 36 may, under certain conditions, not be fully heated, and may exist in the form of small solid pieces. By drawing only completely liquefied and thoroughly heated viscous membrane into impeller assembly 102, the possibility of the viscous membrane solidifying and clogging up pipe assembly 200 is reduced significantly. In addition, by elevating slightly the front end 42 of kettle 30, any undissolved portions of the plastic covering on the solid blocks of viscous membrane will tend to migrate toward the lower end of chamber 36. As a consequence of this migration, the possibility of such undissolved portions of plastic covering being drawn into impeller assembly 102 is reduced significantly. By avoiding drawing the plastic covering into impeller assembly 102, the possibility of clogging pipe assembly 140 or pipe assembly 200 with such portions of plastic covering is reduced significantly.

Since certain changes may be made in the above system without departing from the scope of the invention herein involved, it is intended that all matter contained in the above description or shown in the accompanying drawings shall be interpreted in an illustrative and not in a limiting sense.

The embodiments of the invention in which an exclusive property or privilege is claimed are defined as follows:

1. A system for transporting liquefied viscous membrane from a first location to a second location remote from said first location, the system comprising:

pipe means for enclosing a first passageway through which a stream of liquefied viscous membrane may be transported, said first passageway being positionable so as to extend from a first location to a second location, said pipe means including heat-generating means surrounding said first passageway for delivering 40 to 60 watts of heat on a continuous basis to each one-foot length of said first passageway so as to ensure viscous membrane located in said first passageway remains in a liquid state at a selected temperature; and pump means, coupled with said pipe means, for delivering liquefied viscous membrane to said pipe means at said first location so as to cause said liquefied viscous membrane to travel through said passageway from said first location to said second location.

2. A system according to claim 1, wherein said pipe means includes a plurality of pipe sections, each comprising:

a first pipe having a central bore extending therethrough defining said first passageway;

a second pipe having a central bore extending therethrough, said second pipe being positioned in concentric relation with said first pipe so that said first pipe is positioned in said central bore of said second pipe; and wherein said heat-generating means comprises an electric heating coil surrounding said first pipe, said heating coil being designed to deliver 40 to 60 watts of heat on a continuous basis to each one-foot length of said first pipe.

3. A method of transporting liquefied viscous membrane from a first location to a second location remote from said first location, the method comprising the following steps:

providing a kettle for storing a quantity of liquefied viscous membrane at a selected temperature at a first location, said kettle having a chamber for containing said viscous membrane, said chamber having first and second ends and a bottom surface;

elevating said first end of said chamber 2 to 6 inches with respect to said second end of said chamber;

providing an elongate passageway that is open at both ends and extends from a position adjacent said first location to a second location; and withdrawing liquefied viscous membrane from said chamber adjacent said first end of said chamber at a location near said bottom surface of said chamber and delivering said withdrawn viscous membrane to said elongate passageway so as to cause said withdrawn liquefied viscous membrane to travel through said passageway from said first location to said second location and to be dispensed from said passageway at said second location.

4. A method according to claim 3, further comprising the step of applying sufficient heat to said passageway to maintain the temperature of liquefied viscous membrane in said passageway at said selected temperature.

5. A system for transporting liquefied viscous membrane from a first location to a second location remote from said first location, the system comprising:

(a) pipe means for providing a passageway through which a stream of liquefied viscous membrane may be transported, said passageway being positionable so as to extend from a position adjacent the first location to the second location, said pipe means including a plurality of pipe assemblies, each of which pipe assemblies includes:

(i) a first pipe having a central bore;

(ii) coupling means, attached to opposite ends of said first pipe, for coupling said first pipe with other of said first pipes in said plurality of pipe assemblies so that said central bore of said first pipe is in communication with the central bores of said other first pipes, the central bores of coupled ones of said first pipes defining said passageway;

(iii) heat means coupled with said first pipe for providing about 40 to 60 watts of heat on a continuous basis to each one-foot length of said first pipe so that liquefied viscous membrane located in said central bore of said first pipe may be maintained in a liquid state;

(iv) cable means (1) for carrying electrical power from one end of said first pipe to an opposite end of said first pipe and (2) for carrying electrical power to said heating means, said cable means being designed to be connectable in series with the cable means of other of said pipe assemblies;

(v) a thermostat coupled with said cable means and said heat means for controlling the quantity of electrical power provided by said cable means to said heat means independently of the thermostats in other of said pipe assemblies; and (b) pump means, coupled with said pipe means, for delivering liquefied viscous membrane to said pipe means at said first location so as to cause said liquefied viscous membrane to travel through said passageway from said first location to said second location.

6. A system according to claim 5, further comprising:

a kettle for storing a predetermined quantity of viscous membrane at said first location in a liquid state at a selected temperature, said kettle including a chamber for containing said predetermined quantity of viscous membrane, said chamber having a bottom surface; and wherein said pump means includes an intake positioned in said chamber near said bottom surface, said pump means being designed and positioned relative to said kettle so as to withdraw liquefied viscous membrane from said chamber solely through said intake.

7. A system according to claim 5, wherein each end of said first pipe is threaded and said coupling means includes a plurality of pipe coupler unions, each for coupling an end of one of said first pipes with an end of another of said first pipes.

* * * * *